US008480449B2

(12) United States Patent
Cheng

(10) Patent No.: US 8,480,449 B2
(45) Date of Patent: Jul. 9, 2013

(54) TOY BLOCK UNIT HAVING 50 FACES AND A TOY BLOCK GAME SET CONSISTED OF TOY BLOCKS MADE THEREFROM

(75) Inventor: Ming-Hsien Cheng, Chunnghe (TW)

(73) Assignee: Lonpos Braintelligent Co., Ltd., New Taipei (TW)

( * ) Notice: Subject to any disclaimer, the term of this patent is extended or adjusted under 35 U.S.C. 154(b) by 358 days.

(21) Appl. No.: 13/034,623

(22) Filed: Feb. 24, 2011

(65) Prior Publication Data

US 2012/0220185 A1 Aug. 30, 2012

(51) Int. Cl.
*A63H 33/06* (2006.01)
*A63F 9/08* (2006.01)

(52) U.S. Cl.
CPC . *A63H 33/06* (2013.01); *A63F 9/08* (2013.01)
USPC ..... 446/124; 446/85; 273/153 R

(58) Field of Classification Search
CPC ..... A63H 3/06; A63F 9/08
USPC ..... 446/85, 124; 273/153 R
See application file for complete search history.

(56) References Cited

U.S. PATENT DOCUMENTS 3,461,574 A * 8/1969 Larsen et al. ..... 434/403
3,611,620 A * 10/1971 Perry ..... 46/121
3,645,535 A * 2/1972 Randolph ..... 273/157 R
3,945,645 A * 3/1976 Roberts ..... 273/157 R
4,133,538 A * 1/1979 Ambrose ..... 273/276
4,238,905 A * 12/1980 MacGraw, II ..... 446/92
4,288,960 A * 9/1981 Auras ..... 52/604
4,323,245 A * 4/1982 Beaman ..... 273/157 R
4,629,192 A * 12/1986 Nichols ..... 273/156
4,676,507 A * 6/1987 Patterson ..... 273/160
4,719,726 A * 1/1988 Bergman ..... 52/81.4
4,723,382 A * 2/1988 Lalvani ..... 52/81.1
4,934,701 A * 6/1990 Ting ..... 273/157 R
4,988,103 A * 1/1991 Cheng ..... 273/157 R
5,009,625 A * 4/1991 Longuet-Higgins ..... 446/92
5,046,988 A * 9/1991 Bennett ..... 446/487
5,301,953 A * 4/1994 Levin ..... 273/276
5,448,868 A * 9/1995 Lalvani ..... 52/648.1
5,567,194 A * 10/1996 Stapleton ..... 446/124
5,599,221 A * 2/1997 Gabriel ..... 446/128
5,711,524 A * 1/1998 Bauer et al. ..... 273/157 R
5,762,529 A * 6/1998 Nizza ..... 446/85
5,988,640 A * 11/1999 Wheeler ..... 273/241
6,076,318 A * 6/2000 Grimm et al. ..... 52/245
6,220,919 B1 * 4/2001 Cheng ..... 446/117
6,439,571 B1 * 8/2002 Wilson ..... 273/157 R
6,702,285 B2 * 3/2004 Cheng ..... 273/153 R (Continued)

FOREIGN PATENT DOCUMENTS

TW M372207 U1 1/2010

*Primary Examiner* — Gene Kim
*Assistant Examiner* — Alexander Niconovich

(57) ABSTRACT

A toy block set comprises a total 12 toy blocks, each block is consisted of at least one block unit and each unit joins another angledly by a 60 degree. The set includes 8 toy blocks formed by 5 block units and 4 toy blocks formed by 4 block units, a total 56 block units. Each block unit is a polyhedron with 50 faces arranged in 7 layers for improving the stability when assembling the shape formed by the toy blocks. Said 12 toy blocks can form a triangular pyramid of height of 6 units and 7 of said 12 toy blocks can form another triangular pyramid of height of 5 units.

11 Claims, 15 Drawing Sheets

U.S. PATENT DOCUMENTS 6,921,314 B2 * 7/2005 Miller ..... 446/85
7,040,621 B2 * 5/2006 Cheng ..... 273/160
7,140,612 B2 * 11/2006 Chen ..... 273/156
7,677,567 B2 * 3/2010 Chen ..... 273/157 R
8,020,867 B2 * 9/2011 Cheng ..... 273/157 R
8,157,608 B1 * 4/2012 Stapleton ..... 446/124
2010/0237561 A1 * 9/2010 Cheng ..... 273/157 R

* cited by examiner

TOY BLOCK UNIT HAVING 50 FACES AND A TOY BLOCK GAME SET CONSISTED OF TOY BLOCKS MADE THEREFROM

FIELD OF THE INVENTION

The present invention relates to a toy block composed of polyhedral block unit that has 50 faces and a toy blocks game set consisted of said toy blocks.

DESCRIPTION OF PRIOR ART

The traditional toy blocks are usually made into square, triangle or other geometrical shapes for assembling different objects. However, variety of the object which can be built is often restricted by the shapes of the toy blocks. To improve, some toy blocks are composed of single or multiple spherical block units; spherical units allow the user to be able to assemble more complicate object, but since contacting surface of the spherical unit is less than other shape, the assembled object is easier to collapse. To support said toy block, a game tray having multiples grooves for receiving said block units is further provided, however the required space for the game is increased. Therefore, to find a toy block that can stand firmly on a planar surface has become the primary object of the present invention.

Further, said spherical surface may become slippy as the fingers of the user are wet, making the toy block difficult to be held. Thus, to provide a toy block which can be grasped firmly even the finger is wet has become another objective of the present invention.

Applicant has dedicated to design intellectual games for years, and various models with different playing rules has been invented, such as cited document 1, U.S. Pat. No. 6,220,919, entitled "ASSEMBLED BUILDING BLOCK FOR FORMING VARIOUS GEOMETRICAL SHAPES WITH CORNERS HAVING ANGLES 60 DEGREES, 90 DEGREES AND 120 DEGREES", by referring to FIG. 1 of the cited document 1, it discloses a game set having 18 assembling pieces, each is formed by 3 to 6 spherical units. As each unit is joined to another horizontally or vertically, when assembling a pyramid, they can only form a square pyramid as shown in FIGS. 16~19, but unable to assemble a triangular pyramid.

In cited document 2, US 2010/0237561, entitled "TOY BLOCK ASSEMBLY PUZZLE", it discloses a game set including 11 assembling pieces, each is also formed by 3 to 6 spherical unit. The game teaches a new concept of playing the game by limiting the pieces can only be inserted diagonally with an angle of 45 degree; however, it can't be used to form any 3-dimentional shape.

In cited document 3, TW M372207, entitled "A toy block set formed by 54 block units" discloses a game set including 12 assembling pieces, having total 54 cubic block units. By referring to FIGS. 18~21, a triangular pyramid having 21 units for the base and six units for the height can be formed by said 12 pieces; however, a 56 units is required to build the pyramids, thus a game tray having 19 position holes must be provided to complete the assembly.

Moreover, invention from other inventor, such as cited document 4, U.S. Pat. No. 7,140,612, entitled "Cubic assembly puzzle and support structure" of Ronghao Chen discloses an intellectual game having cubic building blocks which can assemble a 3-dimentional shape (FIG. 19), but fails to form a pyramid.

Therefore, to design a new intellectual game which permit the user to build a triangular pyramid firmly even without a supporting structure has become another objective of the present invention.

SUMMARY OF THE INVENTION

To achieve above objectives, a toy block is characterized in that said toy block is consisted of at least one block unit. Each unit comprising 50 adjacent faces, and are arranged in 7 layers, wherein:

- a first layer including one hexagonal face, provided horizontally as a top of the block unit;
- a subjacent second layer including six adjacent pentagonal faces;
- a subjacent third layer including twelve adjacent pentagonal faces, which are set in six symmetrical pairs;
- a subjacent forth layer including twelve adjacent pentagonal faces;
- a subjacent fifth layer including twelve adjacent pentagonal faces, which are set in six symmetrical pairs; faces of the fifth layer and faces of the third layer are arranged symmetrically;
- a subjacent sixth layer including six adjacent pentagonal faces; faces of the six layers and faces of the second layer are symmetrical; and
- a seventh layer including one hexagonal face, provided horizontally as a bottom of the block unit.

To play as an intellectual game, the present invention teaches a toy block set comprising 12 toy blocks, composed of aforementioned block unit, wherein said 12 toy blocks are assembled to form a triangular pyramid having a base with 6 block units provided on each side and a height of 6 block units. The toy block set including 8 toy blocks consisted of 5 block units and 4 toy blocks consisted of 4 block units, a sum of 56 block units; each block unit is connecting to another by a join member.

Beside said triangular pyramid, the first seven toy blocks of the set, with a total 35 block units can be assembled to form another smaller triangular pyramid, having a base with 5 block units provided on each side and a height of 5 block units.

Both pyramids can be built over corresponding game trays. Each game tray has pluralities position holes provided thereon, and the number of the holes matches the number of units of pyramid's base. Said position holes are arranged in an outer and inner triangle. The outer triangle is set approximate the edge of the game tray and the inner triangle is set in the center of the outer triangle. Both are equilateral triangles.

Each position hole is a concave having 19 faces arranged in 3 layers, which match arrangement of the first to third layers or the seventh to fifth layers of the block unit, wherein:

- The first layer including one hexagonal face, provided horizontally as a bottom of the concave;
- The second layer including six adjacent pentagonal faces;
- The third layer including twelve adjacent pentagonal faces.

DETAILED DESCRIPTION OF PREFERRED EMBODIMENTS

Figure 1:
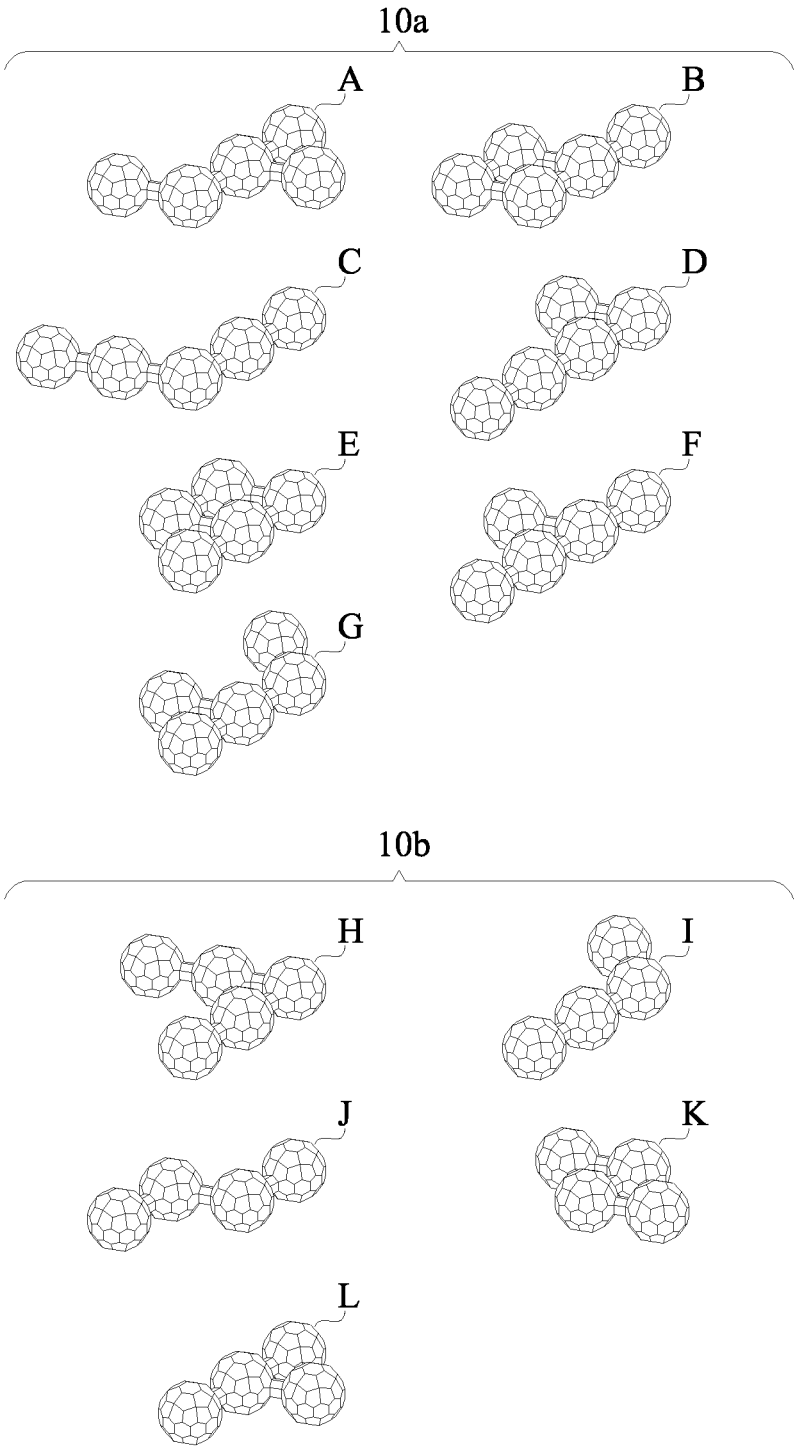
FIG. 1 is a perspective view showing all 12 toy blocks of a toy block set.
Figure 2:
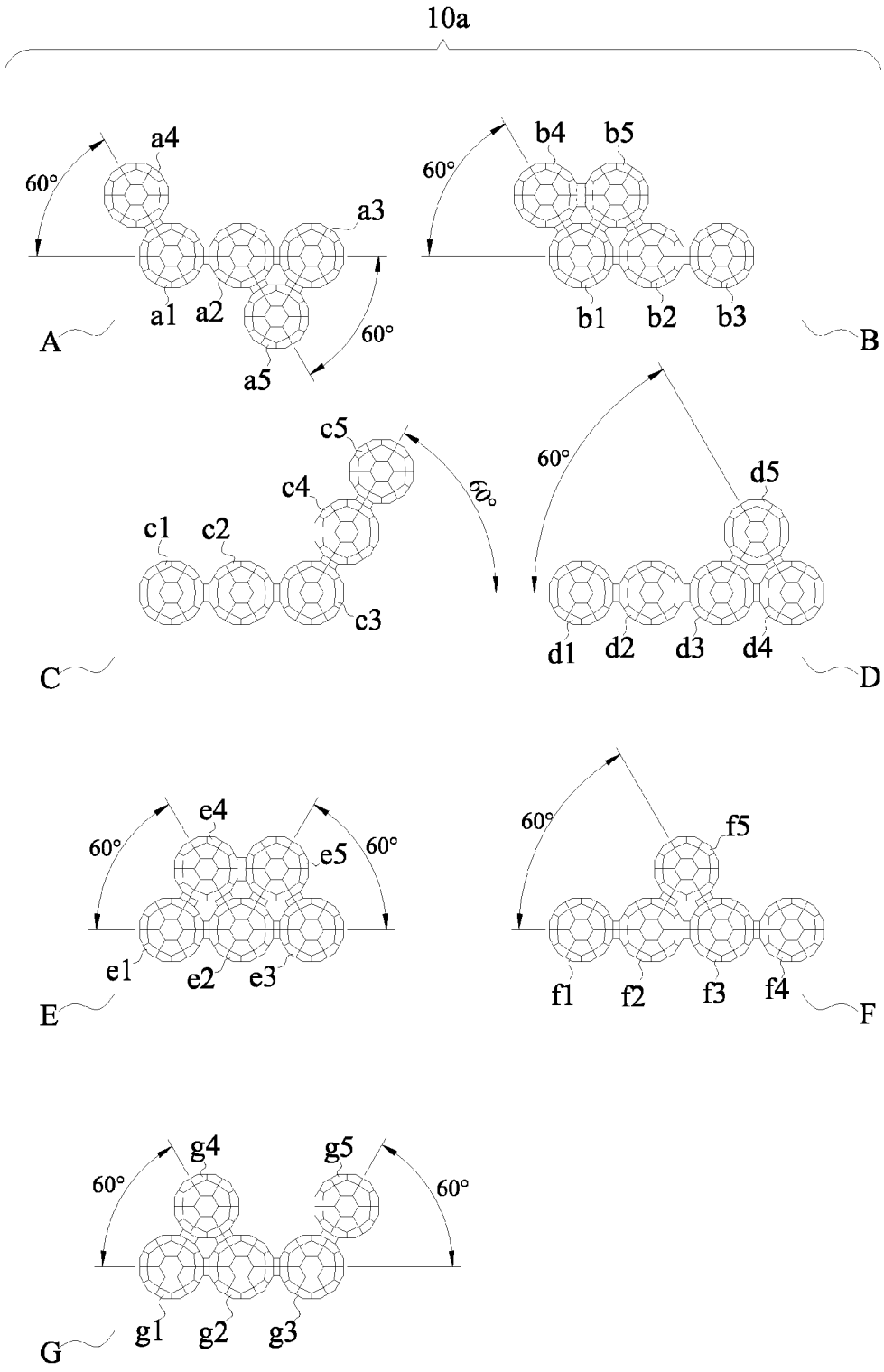
FIG. 2 is a schematic view showing all toy blocks consisting of 5 block units.
Figure 3:
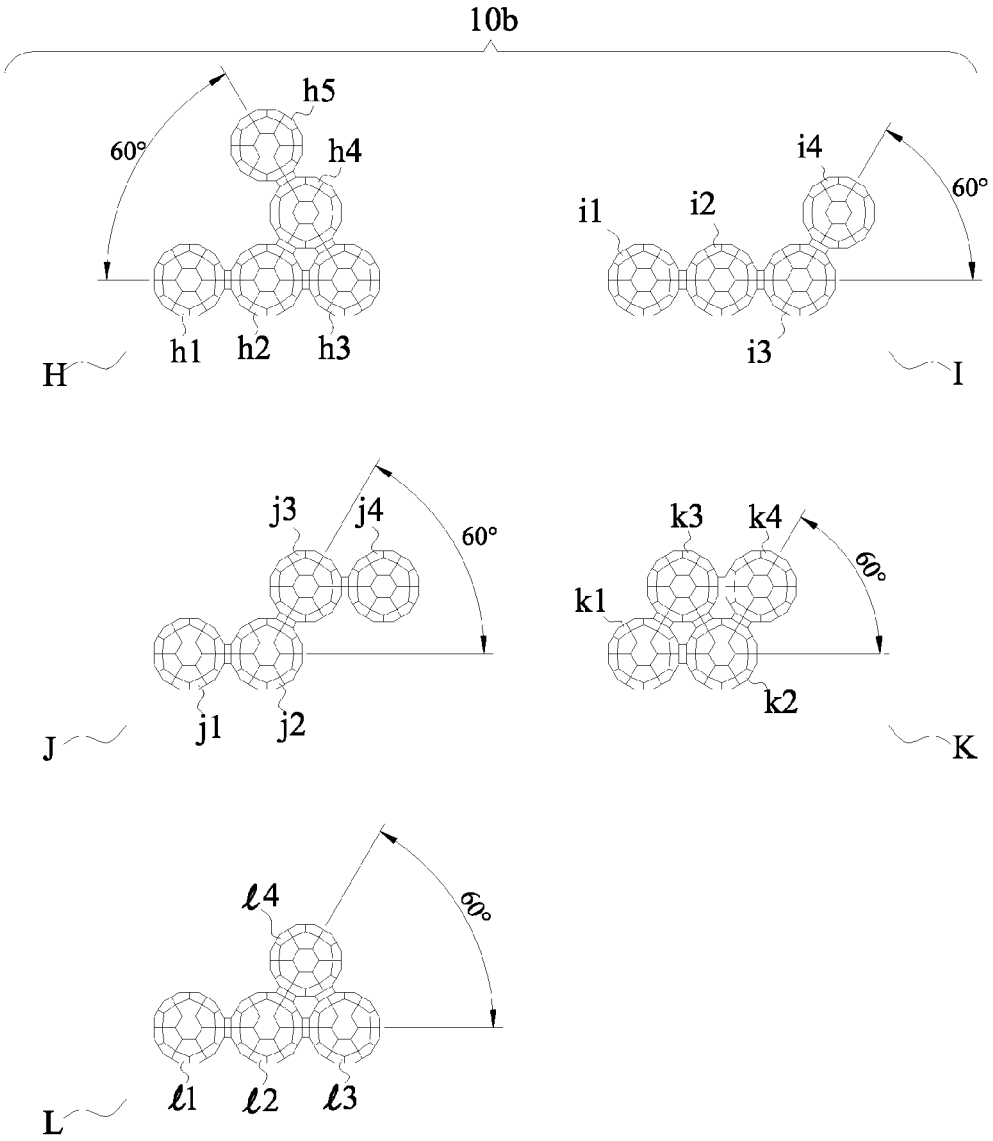
FIG. 3 is a schematic view showing all toy blocks consisting of 4 block units.

The description of preferred embodiments of the present invention is described in detail hereinafter according to the appended drawings.

Referring to FIGS. 1 to 4, a toy block set comprising 12 toy blocks in an alphabetical order from A to L, each toy block is composed of 4 or 5 block units (10), and the block unit (10) is connecting to each other by a join member (11).

Above 12 toy blocks (A~L) are assembled to form a triangular pyramid having a base with 6 block units (10) provided on each side with a height of 6 block units (10). The toy block set including 8 toy blocks (A~H) consisted of 5 block units and 4 toy blocks (I~L) consisted of 4 block units, a total 56 block units (10). Shapes of each 12 blocks (A~L) are described as follows:

Toy block A (A) is formed by 5 block units (a1~a5); a first to third units (a1~a3) are provided on a horizontal plane with a left-to-right order, while a forth unit (a4) provided on a upper left of the first unit (a1), forming an angle of 60 degree with the horizontal plane, and a fifth unit (a5) provided under the second and third unit (a2, a3), forming an equilateral triangle.

Block B (B) is formed by 5 block units (b1~b5). A first to third units (b1~b3) are provided on a horizontal plane with a left-to-right order, while a forth unit (b4) provided on a upper left of the first unit (b1), a fifth unit (b5) provided on a upper left of the second unit (b2), both units (b4, b5) forming an angle of 60 degree with the horizontal plane respectively.

Toy block C (C) is formed by 5 block units (c1~c5). A first to third units (c1~c3) are provided on a horizontal plane with a left-to-right order, while both forth and fifth units (c4, c5) are provided on a upper right of the third unit (c3), forming an angle of 60 degree with the horizontal plane.

Toy block D (D) is formed by 5 block units (d1~d5); a first to forth units (d1~d4) are provided on a horizontal plane with a left-to-right order, while a fifth unit (d5) is provided above the third and forth units (d3, d4), forming an equilateral triangle.

Toy block E (E) is formed by 5 block units (e1~e5); a first to third units (e1~e3) are provided on a horizontal plane with a left-to-right order, while a fourth unit (e4) is provided above the first and second units (e1, e2), forming an equilateral triangle, and a fifth unit (e5) is provided above the second and third units (e2, e3), forming another equilateral triangle.

Toy block F (F) is formed by 5 block units (f1~f5); a first to forth units (f1~f4) are provided on a horizontal plane with a left-to-right order, while a fifth unit (f5) is provided above the second and third units (f2, f3), forming an equilateral triangle.

Toy block G (G) is formed by 5 block units (g1~g5); a first to third units (g1~g3) are provided on a horizontal plane with a left-to-right order, while a fourth unit (g4) is provided above the first and second units (g1, g2), forming an equilateral triangle, and a fifth unit (g5) is provided on a upper-right of the of the third unit (g3), forming an angle of 60 degree with the horizontal plane.

Toy block H (H) is formed by 5 block units (h1~h5); a first to third units (h1~h3) are provided on a horizontal plane with a left-to-right order, while both forth and fifth units (h4, h5) are provided on a upper left of the third unit (h3), forming an angle of 60 degree with the horizontal plane.

Toy block I (I) is formed by 4 block units (i1~i4); a first to third units (i1~i3) are provided on a horizontal plane with a left-to-right order, while a forth unit (i4) is provided on a upper right of the third unit (i3), forming an angle of 60 degree with the horizontal plane.

Toy block J (J) is formed by 4 block units (j1~j4); a first and second units (j1, j2) are provided on a horizontal plane with a left-to-right order and a third and forth units (j3, j4) are provided on another horizontal plane with the same order, while the third unit (j3) is provided on a upper right of the second unit (j2), forming an angle of 60 degree with the horizontal plane of the first and second units (j1, j2).

Toy block K (K) is formed by 4 block units (k1~k4); a first and second units (k1, k2) are provided on a horizontal plane with a left-to-right order, while a third unit (k3) provided on a upper right of the first unit, a forth unit (k4) provided on a upper right of the second unit (k2), both units (k3, k4) forming an angle of 60 degree with the horizontal plane of the first and second units (k1, k2).

Toy block L (L) is formed by 4 block units (l1~l4); a first to third units (l1, l3) are provided on a horizontal plane with a left-to-right order, while a forth unit (l4) is provided above the second and third units (l2, l3), forming an equilateral triangle.

Figure 4:
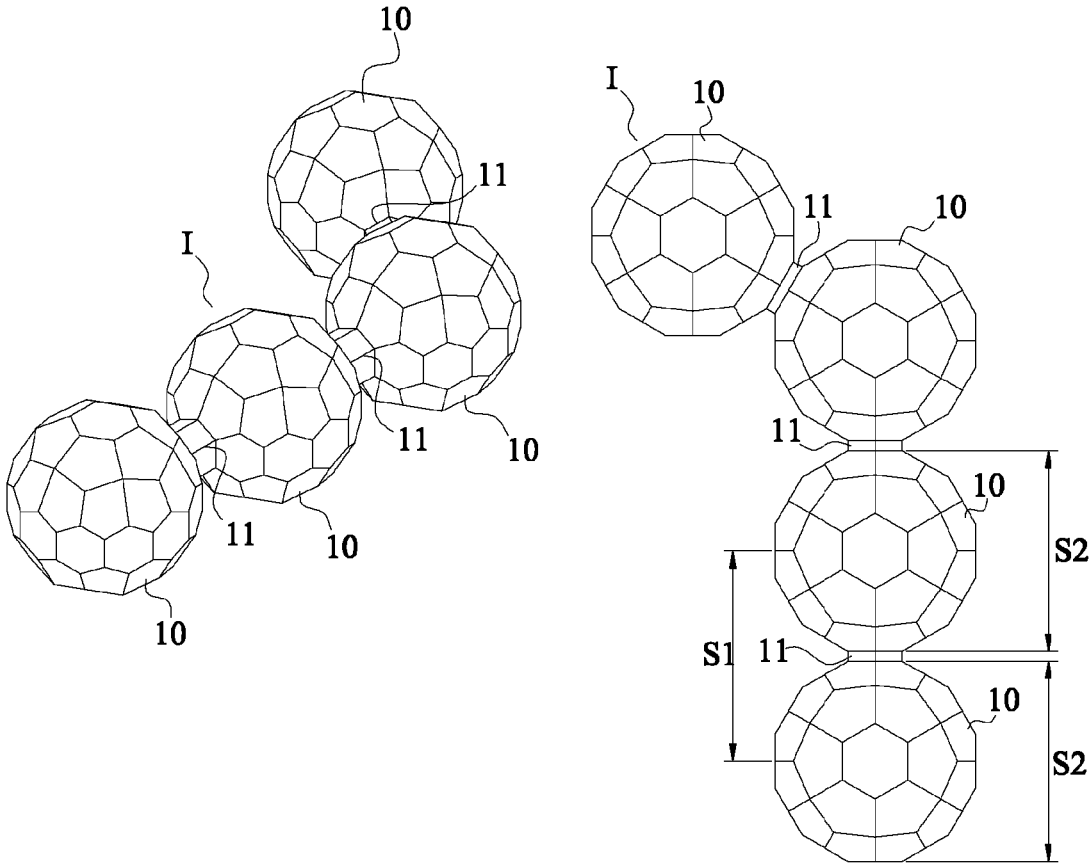
FIG. 4 is a perspective and a top plane view of block I of the FIG. 1.

Referring to FIG. 4, each block unit (10) is recommended to be manufactured by plastic. To avoid rough edge producing by the molding process and to facilitate assembling or disassembling the toy blocks, a permissible dimensional error is preferably set being either 1% longer or 2% shorter than an external diameter of the block unit (10), e.g. in FIG. 4, the outer diameter (S2) is equal to the distance (S1) between centers of two block units; if the outer diameter (S2) is 10 mm, and a radius of each block unit (10) is reduced by a 0.1 mm, an interval of 0.2 mm between two block units is produced, which is the dimensional error. During manufacture, the dimensional error is preferably to be kept between 0.1 mm to 0.2 mm, which can be substitute by a join member (11).

Figure 5:
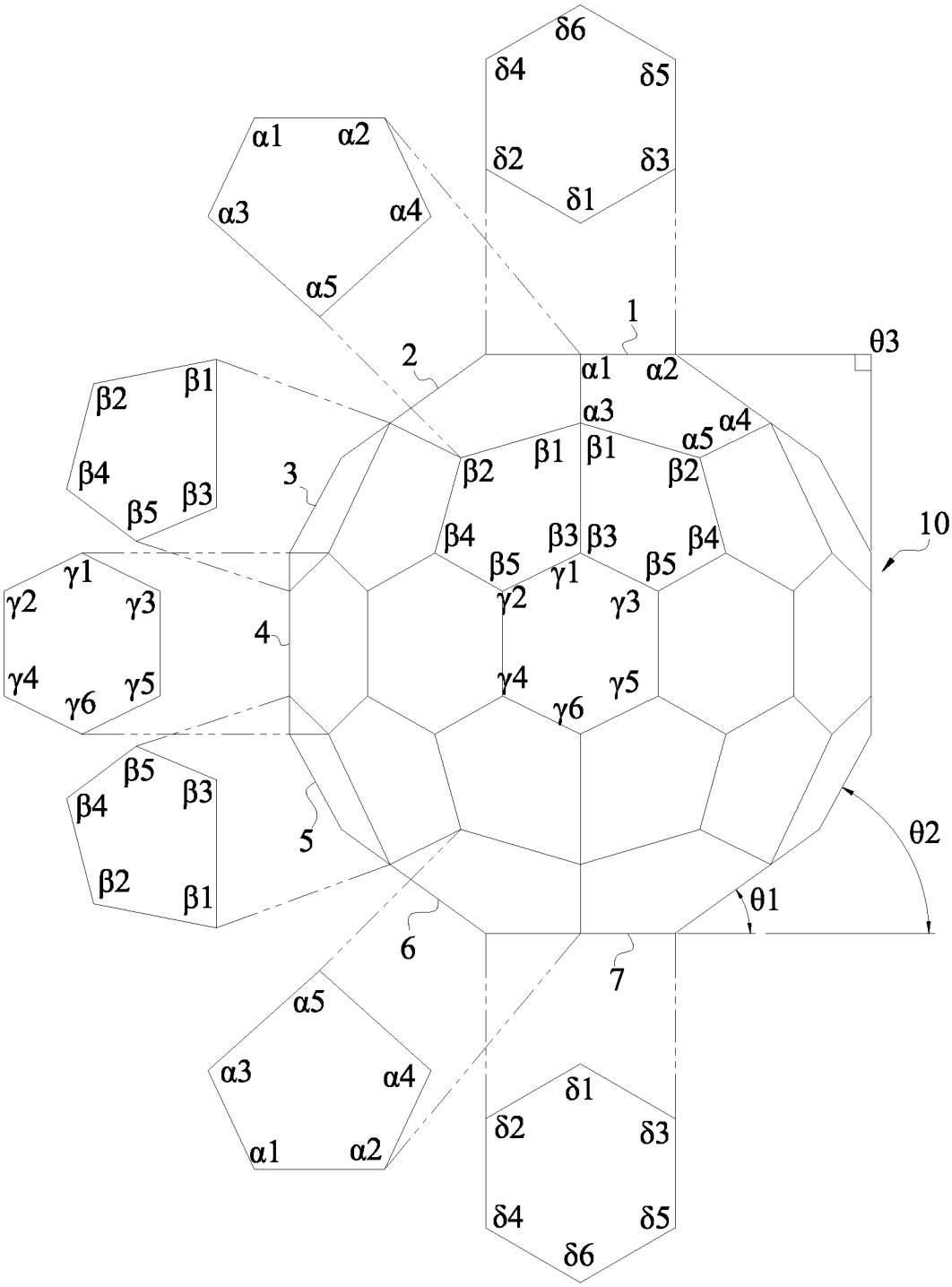
FIG. 5 is a front view of a block unit with a face of each layer shown on the side.

As shown in FIG. 5, each block unit (10) consists of 50 adjacent faces arranged in 7 layers and shapes of faces in different layers are described as follows:

a first layer including one hexagonal face, provided horizontally as a top of the block unit;

a subjacent second layer including six adjacent pentagonal faces;

a subjacent third layer including twelve adjacent pentagonal faces, which are set in six symmetrical pairs;

a subjacent forth layer including twelve adjacent pentagonal faces;

a subjacent fifth layer including twelve adjacent pentagonal faces, which are set in six symmetrical pairs; faces of the fifth layer and faces of the third layer are arranged symmetrically;

a subjacent sixth layer including six adjacent pentagonal faces; faces of the six layers and faces of the second layer are symmetrical; and a seventh layer including one hexagonal face, provided horizontally as a bottom face of the block unit.

Each face on the first and seventh layer is a regular hexagon with each internal angle (δ1-δ6) defined to be 20 degree.

Each face of said second and sixth layer is inclined an angle (θ1) of 35.25 degree to a horizontal plane; each face of said third and fifth layer is inclined an angle (θ2) of 62 degree to the horizontal plane, and each face of the forth layer is inclined an angle (θ3) of 90 degree to the horizontal plane.

Said second and sixth layer is identical and designed primarily for contacting a face of another toy block. Each face of both layers has two internal angles (α1, α2) of 115.24 degree, formed by an edge where butting the face of first layer and a lateral edge thereof, two internal angles (α3, α4) of 92.99 degree, formed by two edges where butting adjacent faces of the same layer and edges butting faces of the third layer, and an internal angle (α5) of 123.53 degree, formed by two edges where butting faces of the third layer.

Each face of the forth layer has two internal angles (γ1, γ6) of 128.09 degree, formed by two edges of two faces of third layer and two edges of two faces of fifth layer; four internal angles (γ2~γ5) of 115.96 degree, formed by two lateral edges thereof and two edges butting the faces of the third layer and the fifth layer.

Said third and fifth layer is identical and each face of both layers has an internal angle (β1) of 79.16 degree, formed by an edge where butting face of the second layer and a lateral edge where butting adjacent face of the same layer, an internal angle (β2) of 115.18 degree, formed by the edge where butting face of the second layer and another lateral edge where butting adjacent face of the same layer, two internal angles (β3, β4) of 112.55 degree, formed by two lateral edges and two edges butting faces of the forth layer, and an internal angle (β5) of 120.57 degree, formed by two edges where butting faces of the forth layer.

Figure 6:
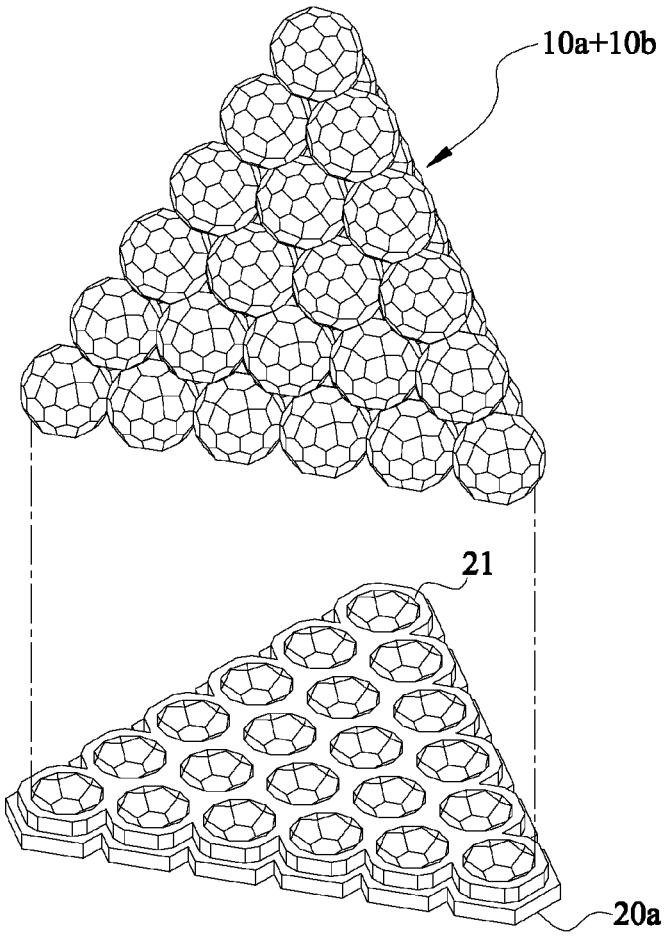
FIG. 6 is a perspective view showing a triangular pyramid assembled by the 12 toy blocks and a first game tray for supporting the base thereof.
Figure 7:
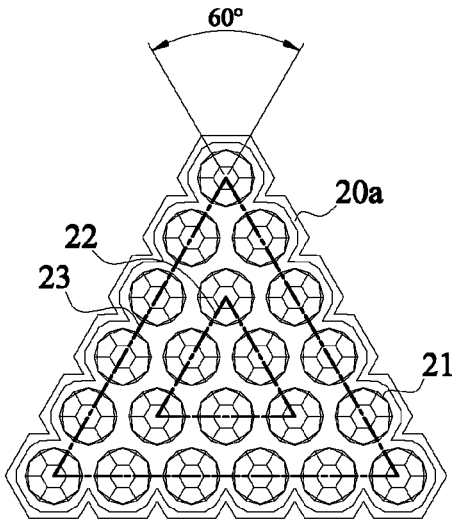
FIG. 7 is a top plane view of FIG. 6.
Figure 8:
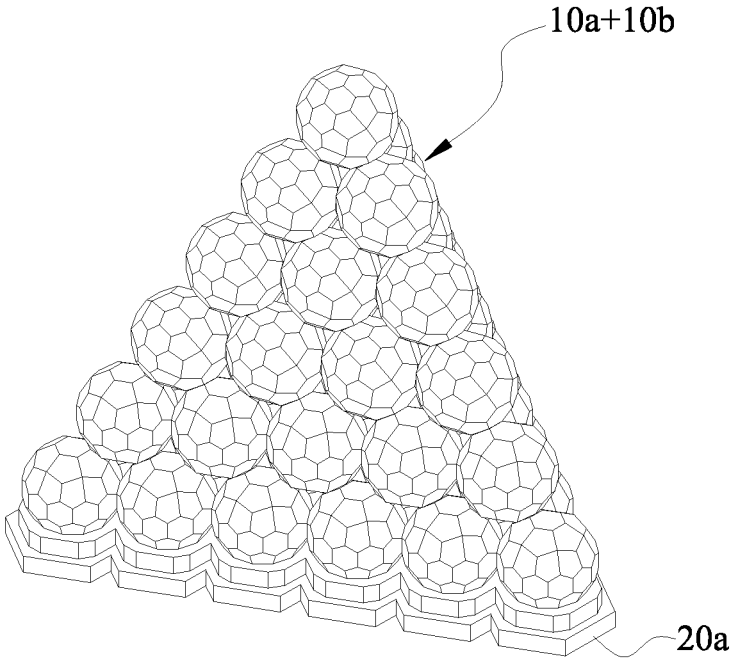
FIG. 8 is a perspective view of the pyramid of FIG. 6 provided on the first game tray.

The regular tetrahedron assembled by said 12 toy blocks (A~L) is shown in FIGS. 6 to 8, and by referring to FIGS. 9 and 10, and relative quantity of block units (10) to construct each layer are disclosed as follows:

First layer (Top layer): 1 unit.
Second layer: 3 units.
Third layer: 6 units.
Fourth layer: 10 units.
Fifth layer: 15 units.
Sixth layer (Bottom layer): 21 one units.
Total: 56 units For a fast and secure assembly, said pyramid formed by all 12 toy blocks can be set upon a first game tray (20*a*), as shown in FIG. 7, having 21 position holes (21) provided thereon for receiving the 21 units of the bottom layer of the pyramid. 15 of said position holes (21) are arranged in an outer triangle (23), approximate to an edge of the game tray (20*a*), and 6 of said position holes (21) are arranged in an inner triangle (22), set in a center of the outer triangle (23). The outer triangle (23) is an equilateral triangle having 6 position holes (21) provided on each side thereof, and said inner triangle (22) is also an equilateral triangle having 3 position holes (21) provided on each side thereof.

Each position hole (21) is a concave having 19 faces arranged in 3 layers, which match the arrangement of the first to third layers or the seventh to fifth layers of the block unit, listed as follows:

A first layer including one hexagonal face, provided horizontally as a bottom of the concave.

A second layer including six adjacent pentagonal faces;

A third layer including twelve adjacent pentagonal faces.

Figure 9:
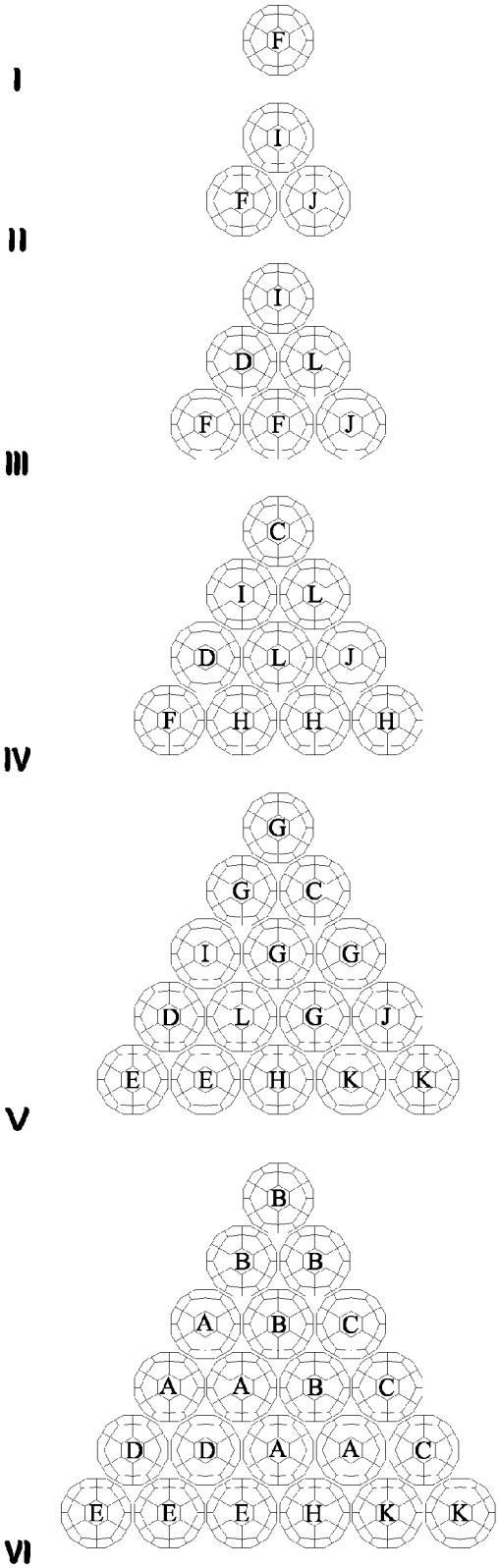
FIGS. 9 and 10 are two possible solutions to assemble the pyramid of FIG. 6.
Figure 10:
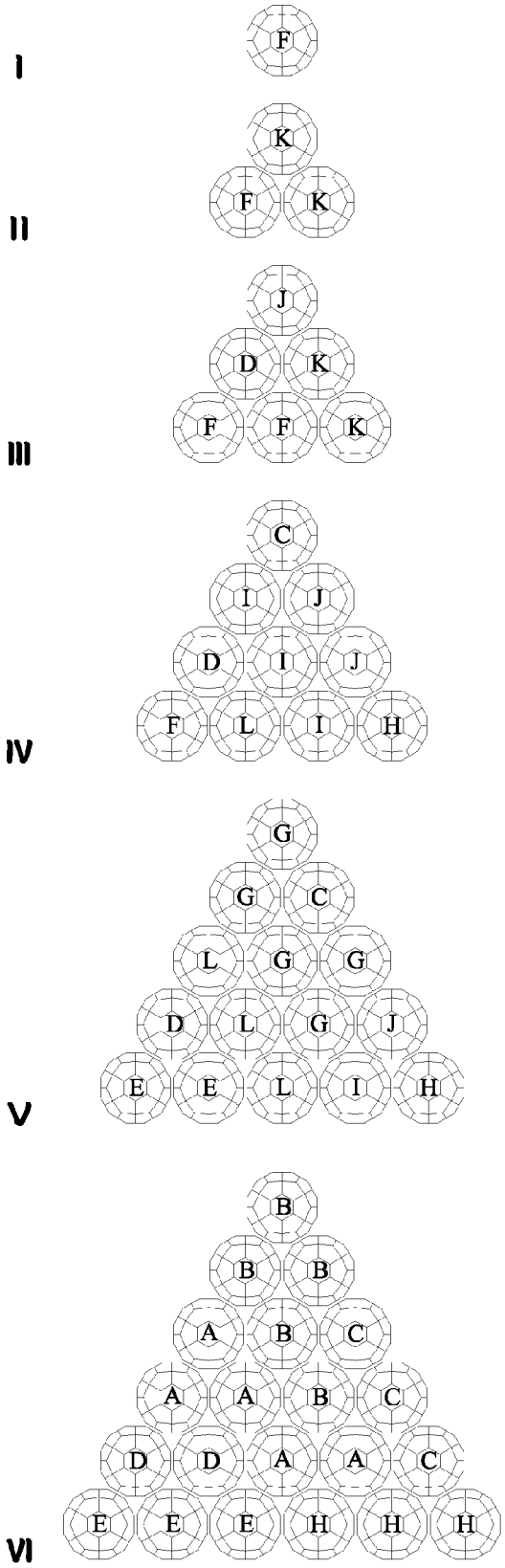

FIGS. 9 and 10 illustrate two possible solutions to assemble the triangular pyramid by showing the cross sectional views thereof. The alphabet shown in the center of the unit indicates the corresponding toy block. More alternative ways can be used to form the pyramid and should not be limited to the solutions disclosed herewith.

The 12 toy blocks (A~L) can be divided into two groups, the first croup (10*a*) includes blocks A~G, while the second group (10*b*) includes blocks H~L. The five toy blocks of said first group (10A) can be assembled to form a smaller triangular pyramid having a base with 5 block units provided on each side and a height of 5 block units.

Figure 11:
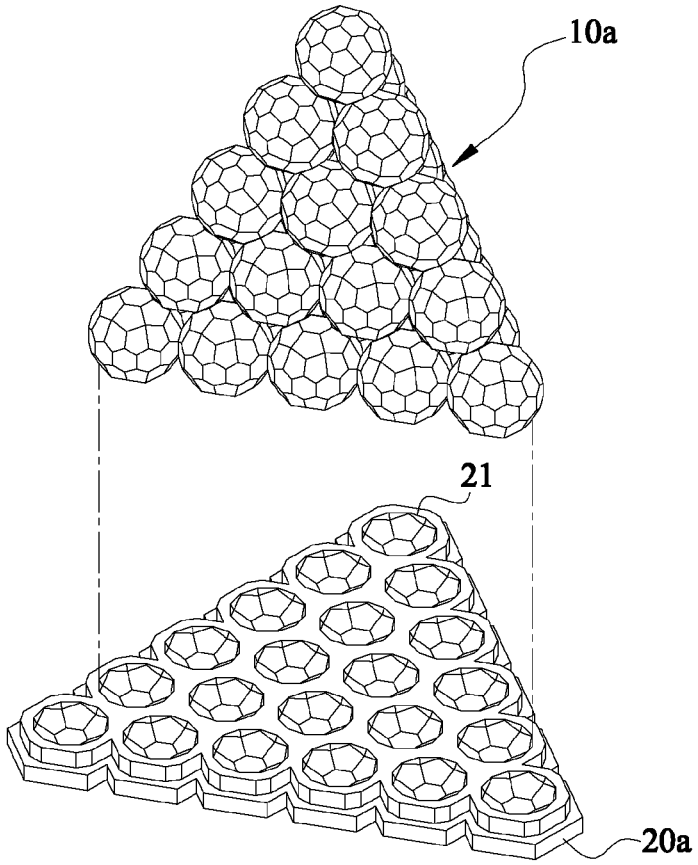
FIG. 11 is a perspective view showing a triangular pyramid assembled by 7 toy blocks and the first game tray for supporting the base thereof.
Figure 12:
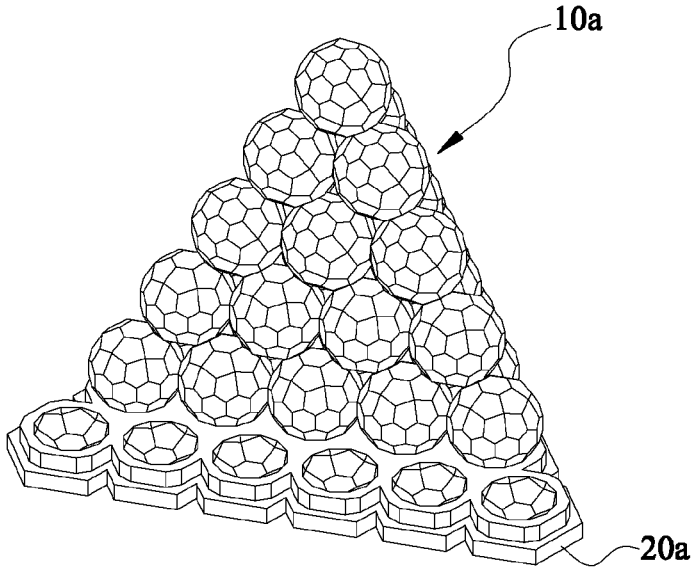
FIG. 12 is a perspective view of the pyramid of FIG. 11 provided on the first game tray.
Figure 13:
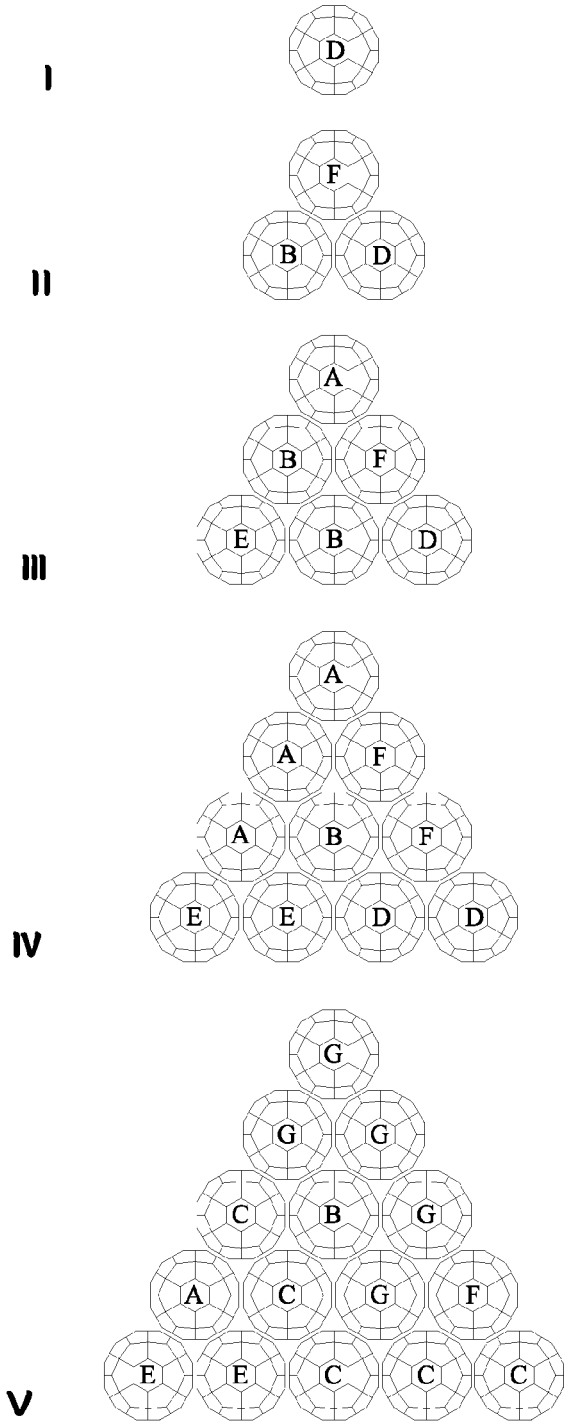
FIGS. 13 and 14 are two possible solutions to assemble the pyramid of FIG. 11.
Figure 14:
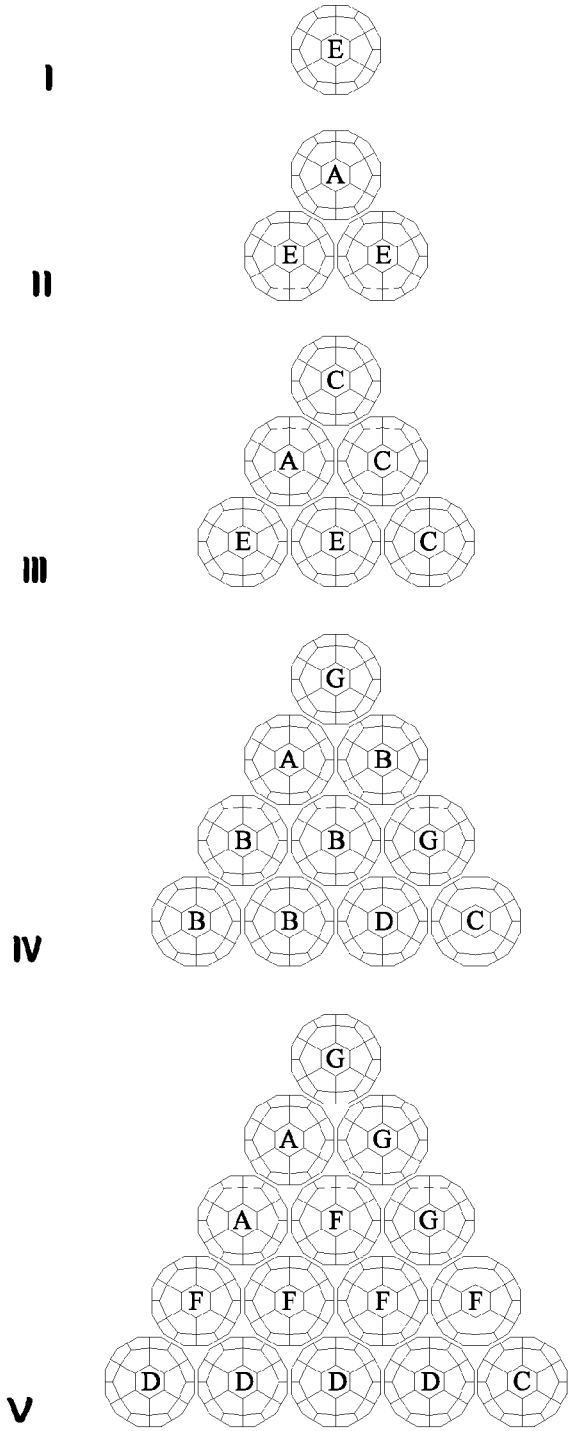

The pyramid assembled by the blocks of first group (10*a*) is shown in FIGS. 11 and 12, and relative quantity of block units (10) to construct each layer are disclosed as follows:

First layer (Top layer): 1 unit.
Second layer: 3 units.
Third layer: 6 units.
Fourth layer: 10 units.
Fifth layer: 15 units.
Total: 35 units FIGS. 13 and 14 illustrate two possible solutions to assemble the mentioned pyramid by showing the cross sectional views thereof. The alphabet shown in the center of each unit indicates the corresponding toy block. More alternative ways can be used to form the pyramid and should not be limited to the solutions disclosed herewith.

Both pyramids can be built upon the first game tray (20*a*) as shown in FIGS. 6, 7, 11 & 12; however, a smaller second game tray (20*b*) can be used specifically to support the pyramid built by blocks of first group (10*a*).

Figure 15:
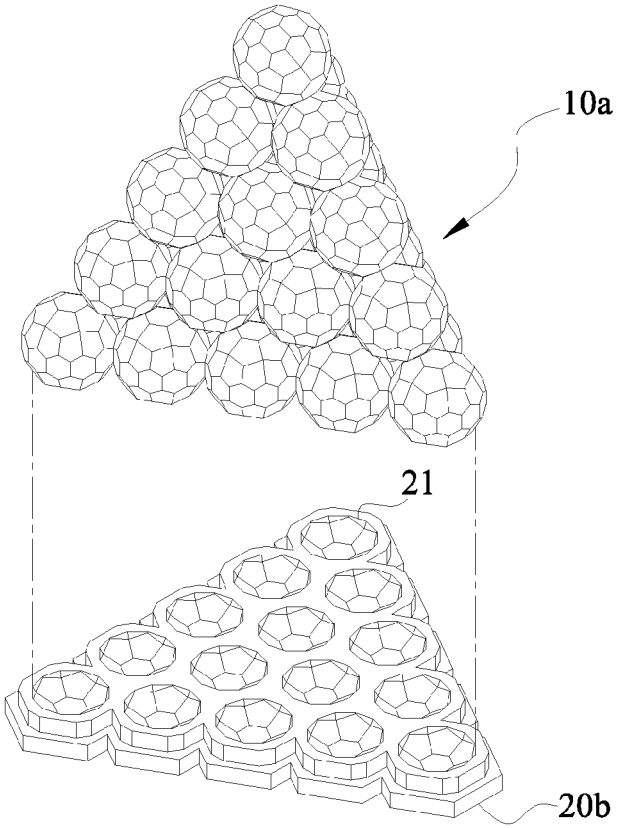
FIG. 15 is a perspective view showing the pyramid of FIG. 11 and a second game tray for supporting the base thereof.
Figure 16:
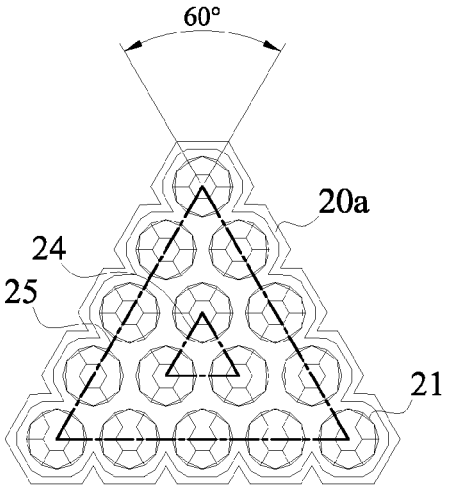
FIG. 16 is a top plane view of FIG. 15.
Figure 17:
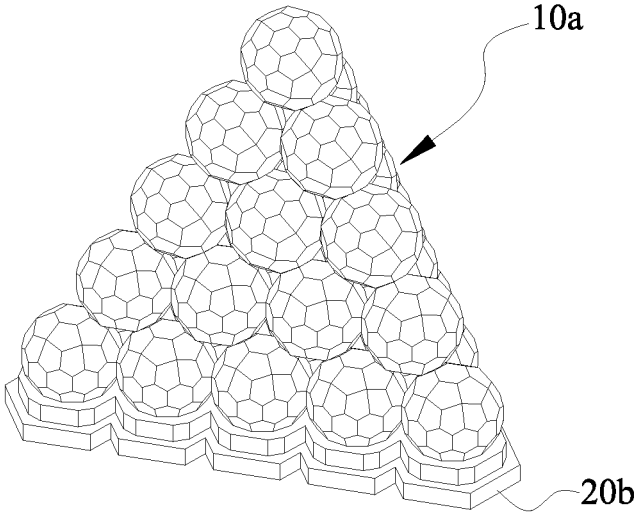
FIG. 17 is a perspective view of the pyramid of FIG. 11 provided on the second game tray.

Referring to FIGS. 15-17, said second game tray (20*b*) has 15 position holes (21) provided thereon for receiving said blocks of the first group (10*a*). Similar to the first game tray (20*a*), 12 of total 15 position holes (21) are arranged to form an outer triangle (25), approximate to an edge of the game tray (20*b*), and 3 position holes (21) are arranged to form an inner triangle (24), set in a center of the outer triangle. The outer triangle (25) is an equilateral triangle having 5 position holes (21) provided on each side thereof, said inner triangle (24) is another equilateral triangle having 2 position holes (21) provided on each side thereof.

Each position hole (21) of the second game tray (20*b*) has the same configuration as of the first game tray (20*a*), therefore, no further description is described hereafter.

Figure 18:
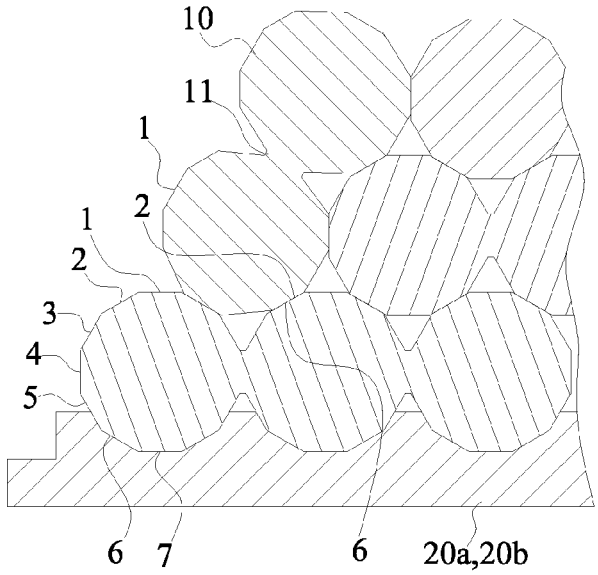
FIG. 18 is a partial sectional view of FIG. 17.

FIG. 18 shows a closer view of the arrangement of toy blocks, unlike the inventions mentioned in previous cited references, which a toy block usually contacts to another by a point. The 50 faces defined on the surface of the unit increase the contacting area, which can secure the assembly, allowing both pyramids being able to stand without the game tray.

Figure 19:
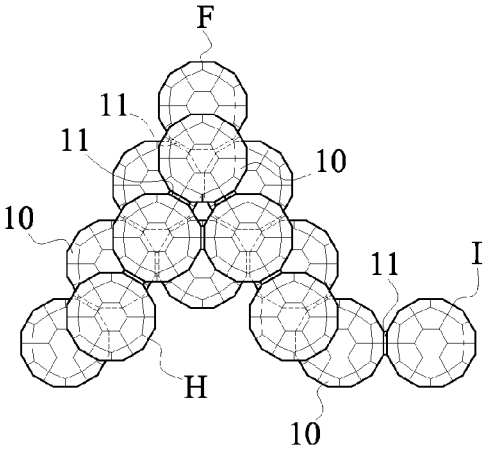
FIG. 19 is a top plane view illustrating arrangement of toy blocks.
Figure 20:
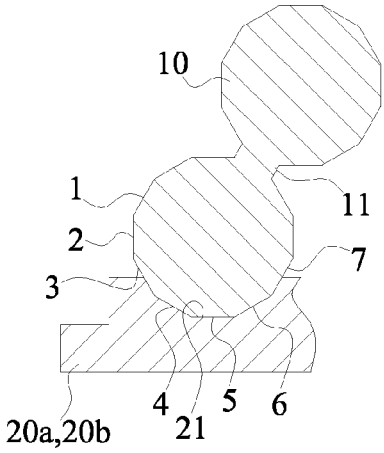
FIG. 20 is a partial sectional view of FIG. 17 showing the block unit is provided inclined on the game tray.

Referring to FIG. 19, when assembling the pyramid, each unit (10) of upper layer will be support by at least 2 block units (10) of below layer, thus the stability of pyramid is improved. FIG. 20 shows a unit of a toy block is provided in the position hole (21) with an inclination. Such pose can't be performed if the block unit has a spherical shape. The design of the block unit can secure the position of the toy block, beneficial as the toy block needs to be placed by an inclination.

The advantages and novelty of the present application comparing with prior arts are listed in following tables:

Comparison with Conventional Block Unit:

| | Conventional | Present application |
|---|---|---|
| Shape | Spherical | Polyhedral |
| Surface | Smooth with curvature | 50 faces |
| Contact with other unit | By point | By face |
| Assemble stability | Easy to collapse | Stable |
| Non-slip ability | Bad | Good |
| Appearance | Normal | Attractive |
| Recognizable | No | Yes |
| Novelty | No | Yes |

Comparison with Other Polyhedral Block Unit:

| No. faces of each block unit | Vantage/Disadvantage |
|---|---|
| More than 50 | Low stability, High manufacture cost |
| 50 | High Stability, Economic for manufacture, Attractive |
| Less than 50 | Low stability, Difficult for assembly, Non attractive |

Comparison with Assembling Pieces of Cited Document 4

| | Cited document 4 | Present application |
|---|---|---|
| Shape of unit | Cubic | Polyhedral |
| Corner angle of unit | 90 degree | 60 degree |
| Total unit | 54 | 56 |
| Position holes on game tray | 19 | 21 |
| Assembling Arrangement | Horizontal/Vertical | Diagonal |
| Playing without game tray | Can't form a pyramid | Can form a pyramid |
| Other 3-Dimentional shape | NO | A triangular pyramid of 35 units |

The invention claimed is:

1. A toy block of a toy blocks game set is characterized in that:

said toy block is consisted of at least one block unit; each unit comprising 50 adjacent faces, and are arranged in 7 layers, wherein:

a first layer including one hexagonal face, provided horizontally as a top of the block unit;

a subjacent second layer including six adjacent pentagonal faces;

a subjacent third layer including twelve adjacent pentagonal faces, which are set in six symmetrical pairs;

a subjacent fourth layer including twelve adjacent pentagonal faces;

a subjacent fifth layer including twelve adjacent pentagonal faces, which are set in six symmetrical pairs; faces of the fifth layer and faces of the third layer are arranged symmetrically;

a subjacent sixth layer including six adjacent pentagonal faces; faces of the six layers and faces of the second layer are symmetrical; and a seventh layer including one hexagonal face, provided horizontally as a bottom of the block unit.

2. The toy block of claim 1, wherein each face of said second and sixth layer is inclined 35.25 degree to a horizontal plane; each face of said third and fifth layer is inclined 62 degree to the horizontal plane, and each face of the fourth layer is perpendicular to the horizontal plane.

3. The toy block of claim 1, wherein each face of said second and sixth layer is identical and is designed primarily for contacting a face of another toy block; each face has two internal angles of 115.24 degree, formed by an edge where butting the face of first layer and a lateral edge thereof, two internal angles of 92.99 degree, formed by two edges where butting adjacent faces of the same layer and edges butting faces of the third layer, and an internal angle of 123.53 degree, formed by two edges where butting faces of the third layer.

4. The toy block of claim 3, wherein each face of said fourth layer has two internal angles of 128.09 degree, formed by two edges of two faces of third layer and two edges of two faces of fifth layer; four internal angles of 115.96 degree, formed by two lateral edges thereof and two edges butting the faces of the third layer and the fifth layer.

5. The toy block of claim 3, wherein each face of said third and fifth layer is identical and each face has an internal angle of 79.16 degree, formed by an edge where butting face of the second layer and a lateral edge where butting adjacent face of the same layer, an internal angle of 115.18 degree, formed by the edge where butting face of the second layer and another lateral edge where butting adjacent face of the same layer, two internal angles of 112.55 degree, formed by two lateral edges and two edges butting faces of the fourth layer, and an internal angle of 120.57 degree, formed by two edges where butting faces of the fourth layer.

6. A toy blocks game set comprising 12 toy blocks in an alphabetical order from A to L, composed of the block unit disclosed in claim 1, characterized in that:

said 12 toy blocks are assembled to form a triangular pyramid having a base with 6 block units provided on each side and a height of 6 block units; the toy block set including 8 toy blocks consisted of 5 block units and 4 toy blocks consisted of 4 block units, a total 56 block units; each block unit is connecting to another by a join member, wherein:

block A is formed by 5 block units; a first to third units are provided on a horizontal plane with a left-to-right order, while a fourth unit provided on a upper left of the first unit, forming an angle of 60 degree with the horizontal plane, and a fifth unit provided under the second and third unit, forming an equilateral triangle;

block B is formed by 5 block units; a first to third units are provided on a horizontal plane with a left-to-right order, while a fourth unit provided on a upper left of the first unit, a fifth unit provided on a upper left of the second unit, both units forming an angle of 60 degree with the horizontal plane;

block C is formed by 5 block units; a first to third units are provided on a horizontal plane with a left-to-right order, while both fourth and fifth units are provided on a upper right of the third unit, forming an angle of 60 degree with the horizontal plane;

block D is formed by 5 block units; a first to fourth units are provided on a horizontal plane with a left-to-right order, while a fifth unit is provided above the third and fourth units, forming an equilateral triangle;

block E is formed by 5 block units; a first to third units are provided on a horizontal plane with a left-to-right order, while a fourth unit is provided above the first and second units, forming an equilateral triangle, and a fifth unit is provided above the second and third units, forming another equilateral triangle;

block F is formed by 5 block units; a first to fourth units are provided on a horizontal plane with a left-to-right order, while a fifth unit is provided above the second and third units, forming an equilateral triangle;

block G is formed by 5 block units; a first to third units are provided on a horizontal plane with a left-to-right order, while a fourth unit is provided above the first and second units, forming an equilateral triangle, and a fifth unit is provided on a upper-right of the of the third unit, forming an angle of 60 degree with the horizontal plane;

block H is formed by 5 block units; a first to third units are provided on a horizontal plane with a left-to-right order, while both fourth and fifth units are provided on a upper left of the third unit, forming an angle of 60 degree with the horizontal plane;

block I is formed by 4 block units; a first to third units are provided on a horizontal plane with a left-to-right order, while a fourth unit is provided on a upper right of the third unit, forming an angle of 60 degree with the horizontal plane;

block J is formed by 4 block units; a first and second units are provided on a horizontal plane with a left-to-right order and a third and fourth units are provided on another horizontal plane with the same order, while the third unit is provided on a upper right of the second unit, forming an angle of 60 degree with the horizontal plane of the first and second units;

block K is formed by 4 block units; a first and second units are provided on a horizontal plane with a left-to-right order, while a third unit provided on a upper right of the first unit, a fourth unit provided on a upper right of the second unit, both units forming an angle of 60 degree with the horizontal plane;

block L is formed by 4 block units; a first to third units are provided on a horizontal plane with a left-to-right order, while a fourth unit is provided above the second and third units, forming an equilateral triangle.

7. The toy block set of claim 6, wherein a first game tray having 21 position holes are provided for receiving said 12 blocks, forming said pyramid; 15 of said position holes are arranged in an outer triangle, approximate to an edge of the game tray, and 6 of said position holes are arranged in an inner triangle, set in a center of the outer triangle; said outer triangle is an equilateral triangle having 6 position holes provided on each side thereof, said inner triangle is an equilateral triangle having 3 position holes provided on each side thereof.

8. The toy block set of claim 7, wherein each position hole is a concave having 19 faces arranged in 3 layers, which match arrangement of the first to third layers or the seventh to fifth layers of the block unit, wherein:

a first layer including one hexagonal face, provided horizontally as a bottom of the concave;

a second layer including six adjacent pentagonal faces;

a third layer including twelve adjacent pentagonal faces.

9. The toy block set of claim 6, wherein said blocks A to G having a total of 35 block units to form a triangular pyramid having a base with 5 block units provided on each side and a height of 5 block units.

10. The toy block set of claim 9, wherein a second game tray having 15 position holes are provided for receiving said blocks A to G, forming said pyramid; 12 of said position holes are arranged in an outer triangle, approximate to an edge of the game tray, and 3 of said position holes are arranged in an inner triangle, set in a center of the outer triangle; said outer triangle is an equilateral triangle having 5 position holes provided on each side thereof, said inner triangle is an equilateral triangle having 2 position holes provided on each side thereof.

11. The toy block set of claim 10, wherein each position hole is a concave having 19 faces arranged in 3 layers, which match arrangement of the first to third layers or the seventh to fifth layers of the block unit, wherein:

a first layer including one hexagonal face, provided horizontally as a bottom of the concave;

a second layer including six adjacent pentagonal faces;

a third layer including twelve adjacent pentagonal faces.

* * * * *